US005273489A

United States Patent [19]

Clarkson

[11] Patent Number: 5,273,489

[45] Date of Patent: Dec. 28, 1993

[54] BOOK OF REMOVABLE FORMS AND CORRESPONDING RECORD COUNTERFOILS

[75] Inventor: Ian R. Clarkson, Glasgow, Scotland

[73] Assignee: Glasgow Miocene Limited, Glasgow, Scotland

[21] Appl. No.: 968,820

[22] Filed: Oct. 30, 1992

[51] Int. Cl.[5] ..... B41L 1/24

[52] U.S. Cl. ..... 462/60; 462/54

[58] Field of Search ..... 462/53-60; 503/200, 201, 226

[56] References Cited

U.S. PATENT DOCUMENTS

| | | | |
|---|---|---|---|
| 1,381,447 | 6/1921 | Bottle | 462/57 |
| 2,840,393 | 6/1958 | Youngquist | 462/57 |
| 4,722,553 | 2/1988 | Evans | 462/57 |

*Primary Examiner*—Paul A. Bell
*Assistant Examiner*—Kenneth S. Hansen
*Attorney, Agent, or Firm*—Krass & Young

[57] ABSTRACT

A book of removable forms such as a cheque book, also comprises interleaved counterfoils, secured at the fold line of the book cover, on which a copy is produced when the cheque is written. Separators are provided between cheques and respective counterfoils (except for the uppermost cheque which is ready to write). After writing and removing a cheque, its separator is automatically partially withdrawn by the action of folding back its counterfoil for storage in a pocket on the cover. The separator is then torn out and discarded, thereby preparing the next cheque to be written and copies made onto its counterfoil. The arrangement allows facsimiles of the cheques to be produced on the counterfoils, which are stored in a non-removable manner.

9 Claims, 3 Drawing Sheets

BOOK OF REMOVABLE FORMS AND CORRESPONDING RECORD COUNTERFOILS

FIELD OF THE INVENTION

The present invention relates to cheque books and similar books containing a stack of removable forms and having means for keeping a record of the information written on the form.

BACKGROUND

Conventional cheque books comprise a stack of blank cheques which are removed by tearing the cheque from a counterfoil bound into the spine of the cheque book. The details of the cheque, such as the date, amount and payee may be recorded on the counterfoil (often referred to as the cheque stub). Instead of cheque stubs, some cheque books include a number of record sheets at the beginning on which details of all the cheques drawn can be recorded together. However, there are a number of problems associated with these conventional methods of recording cheque details.

The writer has to remember to fill in the details of each cheque on the cheque stub or record sheet, and this is very easily forgotten particularly when cheques are written in a hurry. There is a danger of cheques being stolen unnoticed from conventional cheque books, since it is possible for a thief to detach the lowermost cheques, and this often remains undetected until after the stolen cheques are cashed.

It is an object of the present invention to mitigate these problems by providing a cheque book or similar book where a facsimile is automatically made of the cheque details as the cheque is being written.

SUMMARY OF THE INVENTION

The present invention provides a book of removable forms and corresponding record counterfoils which comprises a book cover;

a stack of removable forms removably secured to one edge of the cover;

a corresponding stack of counterfoils non-removably secured to another edge of the cover;

each counterfoil having attached to a rear face thereof a detachable separator sheet, each separator being attached at a side thereof to a position on the counterfoil which is spaced inwardly from the position at which the counterfoil is secured to the edge of the cover;

the rear face of each form and the front face of each counterfoil being treated with pressure sensitive material so that as the form is written a copy is made on the counterfoil;

the forms, counterfoils and separators being regularly interleaved such that (i) a respective counterfoil lies beneath the top form, which is ready to be written, (ii) a separator lies between each other form and its respective counterfoil so that no copy is made on the other counterfoils when the top form is written;

the arrangement being such that after a form is written and removed, folding back of its counterfoil along said edge causes partial withdrawal of the separator beneath the next form, complete withdrawal of the separator preparing the next form to be written and copied onto its respective counterfoil.

Thus, an important feature of the present invention is that as each used counterfoil is folded back out of the way to reveal a fresh unwritten form, the folding back action partially pulls out the separator from under the new form. The separator may then be completely torn out; thus preparing the next form and counterfoil to be used.

The book cover generally folds over in conventional manner, the fold line being positioned adjacent the edge to which are attached the counterfoils. Advantageously, the fold over part of the cover includes a pocket into which used counterfoils can be slid after they have been folded back. The pocket is generally formed integrally with the cover and has an oblique opening to facilitate introducing the used counterfoils.

The counterfoils may be attached to the edge of the cover such that each counterfoil lies substantially flat. However, it is possible that the counterfoils be attached such that they are turned over at the secured ends, and become flat when folded back after use. This may be chosen to produce a book of substantially uniform thickness, which is neater and more convenient.

The edges of the forms are removably secured, preferably to the opposite edge of the cover, optionally via a tear-off strip. Alternatively, the forms and counterfoils might be secured to adjacent edges of the cover (e.g. the top and side edges). If desired in order to assist collating of the pages on assembly of the book, the free end of the counterfoils may also be bound into this edge of the cover, each edge of the counterfoil being provided with a tear off strip, which nevertheless allows the counterfoils to be torn out and withdrawn. Similarly, the free edge of the separator may also be bound into the edge of the cover, each edge being provided with a tear-off strip.

The present invention has particular application to cheque books, where the production of a facsimile copy of the cheque can be useful in proving that a cheque was actually written to a particular payee. Subsequent cashing of the cheque is firm evidence that the cheque was in fact received by the payee. However, the invention may be applied to other books where a form is to be removed and a facsimile copy is to be kept as an exact record. Thus, the present invention may also be applied to order books, receipt books etc. In conventional order books, it is necessary to interleave a carbon sheet between the top copy and record copy. However, this becomes unnecessary in the present invention due to the action of the separator.

At present the cheque stub forms part of the "books" of a business and is required for audit purposes when the auditor or accountant has to do bank reconciliation. All the credits and debits appearing on a business's bank statements have to be reconciled with a counterfoil or cheque stub as proof as to the actual amount. This presents the accounting fraternity with a time consuming chore. The use of a cheque book according to the present invention having a full counterfoil (possibly with a detachable corner) can radically speed up this procedure.

Cheques in the UK may be retained by the banks for up to 5 years. The administration and cost of this requirement is considerable. Any relaxation in this requirement would obviously be welcomed by the banks and their customers, since the latter have to pay for the service and the former have to find places to store the cheques before putting them onto microfilm. A relaxation of these requirements in the long term may be possible using the present invention. Once a chequebook has been used and all the cheques encashed, a statement could be produced listing all the cheques in sequence with their respective amounts. The onus for providing the relevant authorities (e.g. Inland Revenue, Customs & Excise) with proof of payment would then revert to the business or individual and not the bank. The costs and delays of retrieving cheques would be almost entirely eliminated. It may also be feasible in the longer term to use such a certified book of counterfoils backed up by bank statements as a legal proof of payment.

DESCRIPTION OF PREFERRED EMBODIMENTS

Embodiments of the present invention will now be described by way of example only with reference to the accompanying drawings wherein.

Figure 1:
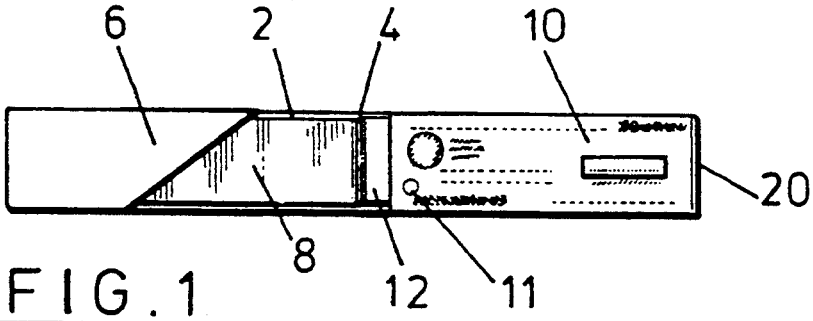
FIG. 1 is plan view of a cheque book according to the present invention.
Figure 2:
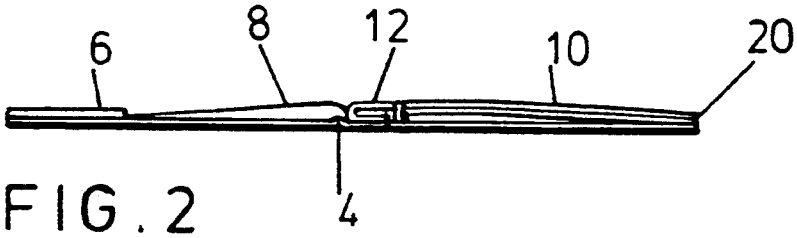
FIG. 2 is a side view thereof.
Figure 3:
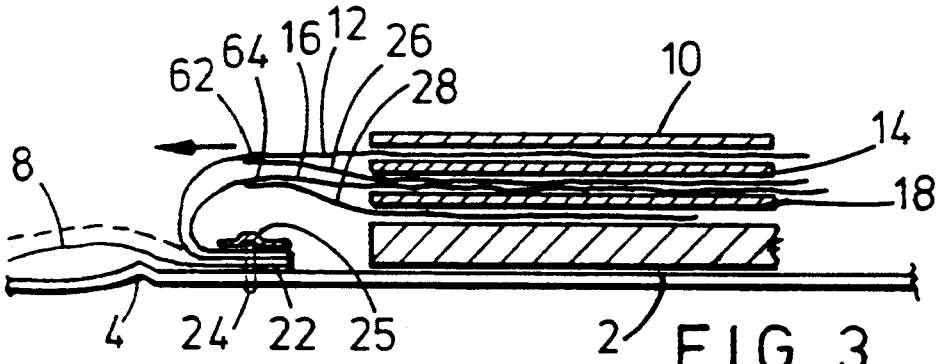
FIG. 3 is a partial enlarged view showing inter leaving of the various sheets.

The cheque book shown in FIGS. 1 to 3 comprises a cover 2 folded along a central fold line 4 and including an oblique-entranced integral pocket 6 to receive used counterfoils e.g. counterfoil 8.

On the right hand side of the fold line is an inter leaved stack of cheques, counterfoils and separators. The arrangement is shown in more detail in FIG. 3 which only shows some of the sheets, for the sake of simplicity. A stack of cheques 10, 14, 18 are bound into a right hand spine 20 using a suitable adhesive and possibly woven fabric. Each cheque carries the usual information and blank spaces to be filled in by the writer, together with a circle 11 in which the writer may put his initials (or other identifying mark or number) so as to identify the signatory. Counterfoils 8, 12, 16 are bound into a left hand spine 22 by means of staples 24. As shown, the counterfoils are then folded over before being interleaved with the cheques. The reverse side of the counterfoil can carry advertising or marketing information on the area not tucked into the pocket 6. The double thickness at the left hand spine helps make the thickness of the cheque book uniform. To further enhance the security of the proposed chequebook, an adhesive strip 25 is placed over the staples securing the counterfoils to the cover. This is a tamper proof device to ensure the sequence of cheques written is strictly in accordance with the numbering on both cheque and counterfoil.

FIG. IA shows (in part) the chequebook with the top cheque removed to leave the counterfoil 12, which bears a facsimile of the information written on the cheque (with the exception of the signature which is blacked out). A circle IIA records the signatories initials. The counterfoil has a line of perforations 13 at 45° across the top right corner, which allows the corner to be torn off by an auditor for bank reconciliation. Alternatively, for personal banking the corner can be removed once the relevant cheque number appears on the bank statement, thereby providing an immediate indication of which cheques are outstanding. Before the counterfoil is moved across and tucked into the pocket, information such as invoice number, net amount VAT amount, issuing department, authorisation code can be added in the boxes 15 shown (which are beneath the position of the Bank's name on the cheque itself). This information is an aid to internal administration and control to a business. The unique cheque number appears on the bottom left of the counterfoil.

Figure 1A:
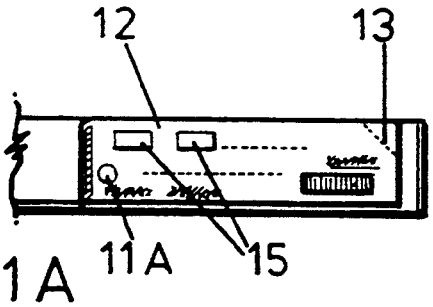
FIGS. 1A and 1B respectively show the chequebook with the top cheque removed, and in the closed state.
Figure 1B:
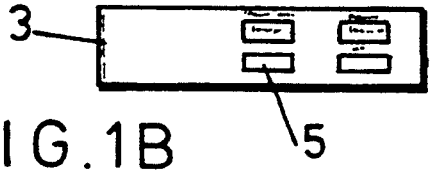

FIG. 1B shows the front 3 of the chequebook cover 2 in its closed state. Windows 5 through the front cover are provided in a two by two array. Usually the cover is of a dark coloured thick paper. A piece of white paper is glued behind the front cover and records respectively the first and last cheque number and the dates they were written, such that this information appears in the windows. This facilitates retrieval and inspection of any particular counterfoil.

Attached to the back of each counterfoil at a position spaced from the spine 22 is a respective separator 26, 28. The separator is made of a thin material, such as tissue paper or a translucent material such as tracing paper. The separator is attached to the back of its respective counterfoil at 62,64 by glue or by crimping or other means of removably mating the two together. The separator may be glued at its edge. Alternatively, it may be bound into the spine and glued to the back of the counterfoil at a position spaced inwardly from the spine (see FIG. 8). The separators are arranged to lie between the cheque and its respective counterfoil. The back of each cheque and the front of each counterfoil is provided with conventional micro-encapsulated copying material which becomes activated when the two are in contact and pressure is applied by writing on the cheque. The presence of the separator between the cheque and its counterfoil prevents a copy being made on the counterfoil until the separator is removed. The arrangement is such that at any one time there is no separator between the top cheque and its counterfoil, so that the top cheque is always ready for writing.

A bank logo, much like those appearing on twin-set credit card transaction forms, could be printed on the separator.

A large portion of the reverse side of the used counterfoil is visible, even when stored normally in the pocket sleeve. This area can be used to carry advertisements or marketing information from the bank, or could be sold by the bank to third parties.

The cheque book may be used as follows. The cheque book cover 2 is folded back to open the cheque book (FIG. 1). The cheque 10 is then written using a pen (ball-point or roller ball pen being preferred). The presence of carbon-less copying material on the reverse side of the cheque and on the front side of the counterfoil 12 causes a facsimile to be produced on the counterfoil. For security reasons the position on the counterfoil beneath the signature box is blanked out so that the signature is not legible on the counterfoil. In business use, to identify the signatory, he writes his initials in circle 11 and these are copied onto the counterfoil in circle 11A. The cheque is removed by tearing away from the spine 20 and delivered to the payee. The used counterfoil 12 is then folded over and slid into pocket 6 in a substantially flat state. Folding over of the counterfoil 12 (as shown in the arrow in FIG. 3) has the effect of partially withdrawing the separator 26 from beneath the next cheque. Once the counterfoil has been slid fully into the pocket, the user tears the separator from the back of the counterfoil, fully withdraws it and discards the separator. This leaves cheque 14 as the top cheque with counterfoil 16 lying immediately beneath it. The removal of separator 26 now allows a facsimile to be produced on counterfoil 16 when cheque 14 is written. The process is repeated for all the other cheques.

Figure 4:
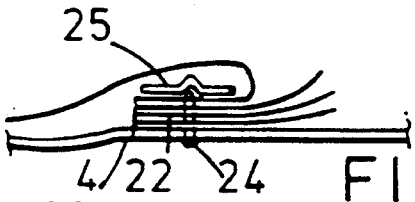
FIG. 4 shows a second embodiment wherein the counterfoils are stapled flat against the book cover.

FIG. 4 shows a second embodiment wherein the ends of the counterfoil are stapled into the left hand spine 22 in a flat condition, and are folded over when used.

Figure 5:
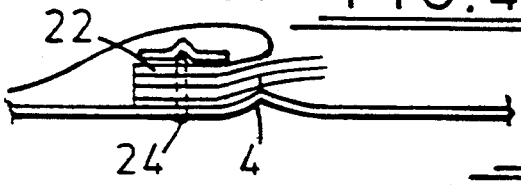
FIG. 5 is a third embodiment wherein the counterfoils are stapled on the other side of the fold line of the cover.

FIG. 5 shows an alternative arrangement, similar to FIG. 4, except that the spine 22 is arrranged on the other side of fold (4).

Figure 6:
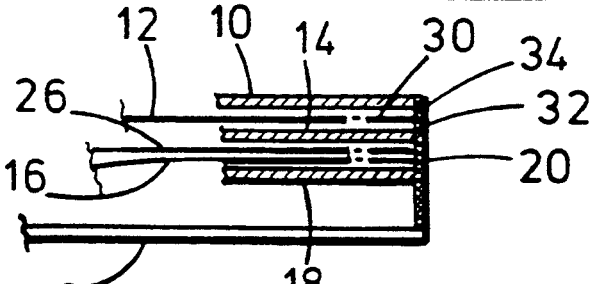
FIG. 6 shows a fourth embodiment wherein the cheques and the counterfoils (with tear off strips) are both bound together into the right hand spine.

FIG. 6 shows an alternative way of forming the right hand spine 20. Each counterfoil 12, 16 is provided with a tear off portion 30, 32 which is bound into the spine 20. Separator 26 is also bound into the spine and provided with a tear off portion 34. This arrangement securely holds in place the various sheets and is a deterrent to tampering with the book.

Figure 7:
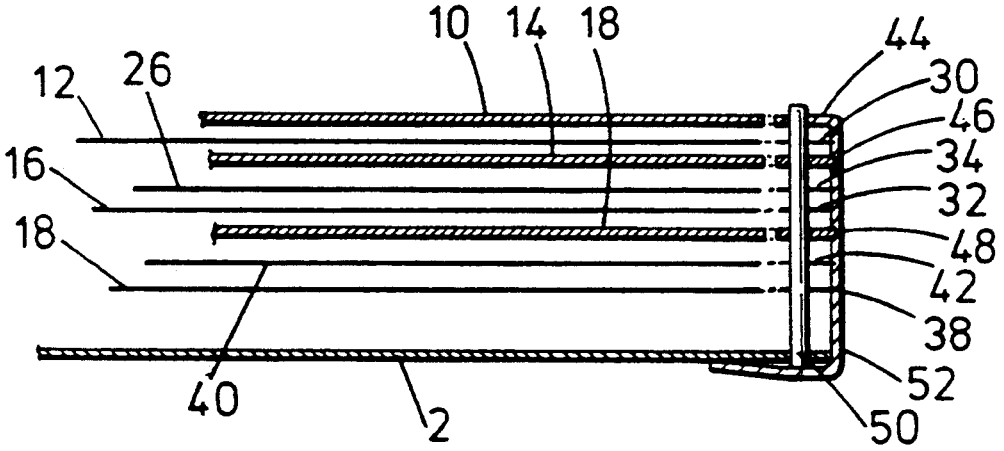
FIG. 7 shows a fifth embodiment which is similar to the fourth embodiment except that the cheques are also provided with a tear-off strip bound into the right hand spine.

FIG. 7 shows a further way of forming the right hand spine 20 which assists collation during production. Each cheque 10, 14, 18 is provided with a tear off portion 44, 46, 48 which is bound into the spine. Each counterfoil 12, 16, 36 is provided with a tear off portion 30, 32, 38 which is bound into the spine 20. Separators 26 and 40 are also bound into the spine and provided with a tear off portion 34, 42. The tear-off portions at the spine are held together by a staple 50 to give strength and durability.

A strong adhesive cloth 52 is attached to the spine and the bottom edge of the cover for additional security and durability.

Figure 8:
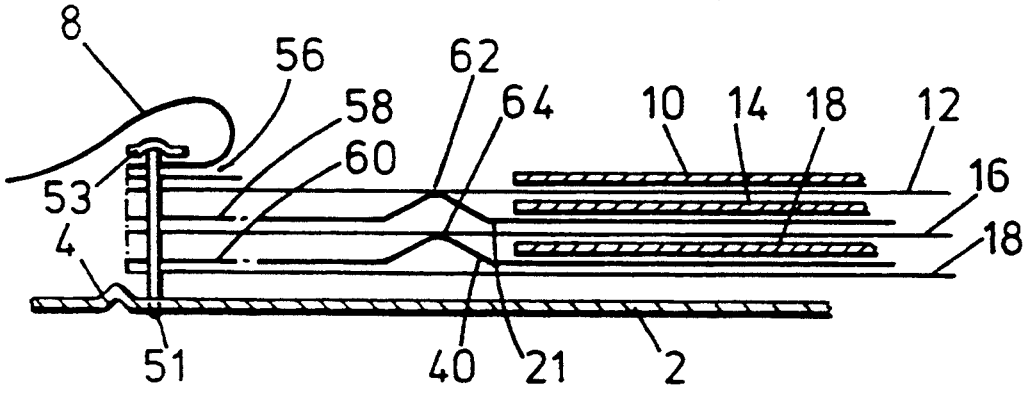
FIG. 8 shows a sixth embodiment wherein the separator is provided with a tear-off strip bound into the left hand spine.

FIG. 8 shows a further way of forming the left spine which simplifies collation and attachment of the separator to the back of the respective counterfoil during production.

As well as being attached to the back of the respective counterfoil at 62, 64, each separator 26, 40 is provided with a tear-off strip 56, 58, 60 bound into the left spine, which assists collation of the separators. The counterfoils 12, 16, 18 and the separator tear-off strips 56, 58, 60 are held together by a staple 51 covered by adhesive cloth tape 53. After the cheque has been written and removed, the counterfoil is folded over and slid into the pocket.

Thus, folding over counterfoil 12 pulls out separator 26 from between the next cheque 14 and its counterfoil 16, since it is attached at 62 to the back of counterfoil 12. The separator may then be discarded by tearing off the back of the counterfoil at 62 and then tearing from the tear-off strip 58.

I claim:

1. A book of removable forms and corresponding record counterfoils which comprises:

a book cover;

a stack of removable forms removably secured to one edge of the cover;

a corresponding stack of counterfoils non-removably secured to another edge of the cover;

each counterfoil having attached to a rear face thereof a detachable separator sheet, each separator being attached at a side thereof to a position on the counterfoil which is spaced inwardly from a position at which the counterfoil is secured to the another edge of the cover;

the rear face of each form and a front face of each counterfoil being treated with pressure sensitive material so that as the form is written a copy is made on the counterfoil;

the forms, counterfoils and separators being regularly interleaved such that (i) a respective counterfoil lies beneath an uppermost of said forms, which is ready to be written;

(ii) a separator lies between each other of said forms and its respective counterfoil so that no copy is made on any other of said counterfoils when the top form is written;

the arrangement being such that after a form is written and removed, folding back of its counterfoil along said edge causes partial withdrawal of the separator beneath the next form, complete withdrawal of the separator preparing the next form to be written and copied onto its respective counterfoil.

2. A book according to claim 1 wherein the stack of removable forms are attached to said one edge of the cover, and the stack of counterfoils are secured to an opposite edge.

3. A book according to claim 1 wherein each of said counterfoils has a free end, and the cover has a central fold line and a fold over portion which folds over to cover the forms, the fold over portion including a pocket in which the free ends of used counterfoils may be retained.

4. A book according to claim 3 wherein the pocket has an oblique opening to facilitate insertion of the used counterfoil ends.

5. A book according to claim 1 wherein each of said counterfoils has an edge portion attached to said another cover edge and the counterfoils are flat prior to interleaving.

6. A book according to claim 1 wherein each separator has an edge attached to the rear face of the respective counterfoil at a position spaced inwardly from the position of securing of the counterfoils to said another cover edge.

7. A book according to claim 1 wherein each separator has a free edge secured to the one edge of the cover in a removable manner.

8. A book according to claim 1 wherein each separator has a free edge secured to said another edge in a removable manner.

9. A book according to claim 1 wherein each counterfoil is attached to said another edge and is removably attached to said edge; and each separator is removably attached to both said another edge and said edge.

* * * * *